US010279378B2

(12) United States Patent
Chapotat et al.

(10) Patent No.: US 10,279,378 B2
(45) Date of Patent: May 7, 2019

(54) CONTAINER FOR CLEANING AN OBJECT SUBMERGED IN A FLUID COMPRISING FERROMAGNETIC COMPONENTS

(71) Applicants: Eric Chapotat, Lyons (FR); Bernard Chapotat, Vienne (FR); Eric Schneck, Lyons (FR)

(72) Inventors: Eric Chapotat, Lyons (FR); Bernard Chapotat, Vienne (FR); Eric Schneck, Lyons (FR)

( * ) Notice: Subject to any disclaimer, the term of this patent is extended or adjusted under 35 U.S.C. 154(b) by 171 days.

(21) Appl. No.: 14/906,881

(22) PCT Filed: Jul. 23, 2014

(86) PCT No.: PCT/FR2014/051901

§ 371 (c)(1),
(2) Date: Jan. 21, 2016

(87) PCT Pub. No.: WO2015/011408

PCT Pub. Date: Jan. 29, 2015

(65) Prior Publication Data

US 2016/0175893 A1 Jun. 23, 2016

(30) Foreign Application Priority Data

Jul. 25, 2013 (FR) ..... 13 57343

(51) Int. Cl.
*B65D 1/44* (2006.01)
*B08B 3/10* (2006.01)
*B24B 31/112* (2006.01)

(52) U.S. Cl.
CPC ..... *B08B 3/10* (2013.01); *B24B 31/112* (2013.01)

(58) Field of Classification Search
CPC ..... B24B 31/112; B65D 1/0233; B65D 1/44
USPC ..... 220/675; 99/484; 366/129
See application file for complete search history.

(56) References Cited

U.S. PATENT DOCUMENTS

| | | | | |
|---|---|---|---|---|
| 4,140,401 | A | 2/1979 | Paschal | |
| 4,890,757 | A * | 1/1990 | Robbins, III | B29C 47/0023 215/12.2 |
| 5,590,782 | A | 1/1997 | Haber et al. | |
| 6,003,720 | A * | 12/1999 | Morimoto | A61C 9/0026 220/608 |
| 7,449,331 | B2 * | 11/2008 | Whitley | C12M 23/08 215/382 |
| 2012/0222564 | A1 * | 9/2012 | Kolano | A47J 43/10 99/484 |

(Continued)

FOREIGN PATENT DOCUMENTS

WO WO-2005/084641 A1 9/2005

OTHER PUBLICATIONS

Search Report for PCT/FR2014/051901, dated Oct. 14, 2014.

*Primary Examiner* — Stephen J Castellano
(74) *Attorney, Agent, or Firm* — Marshall, Gerstein & Borun LLP

(57) ABSTRACT

A container for the cleaning of an object, intended to receive, in addition to the object to be cleaned, a fluid including ferromagnetic components, and intended to be submitted to the action of a magnetic field generated by the rotation of magnets. The container comprises a bottom wall, a lateral wall, and a removable closing lid, said container being transparent to the magnetic field. The lateral wall of said container comprises on its inside radially-protruding longitudinal fins.

2 Claims, 1 Drawing Sheet

(56) References Cited

U.S. PATENT DOCUMENTS

| | | | | |
|---|---|---|---|---|
| 2013/0077433 | A1 | 3/2013 | Conti | |
| 2013/0270211 | A1* | 10/2013 | Perrone | B65D 1/0246 215/44 |
| 2014/0069884 | A1* | 3/2014 | Paredes | B65D 21/0217 215/10 |

* cited by examiner

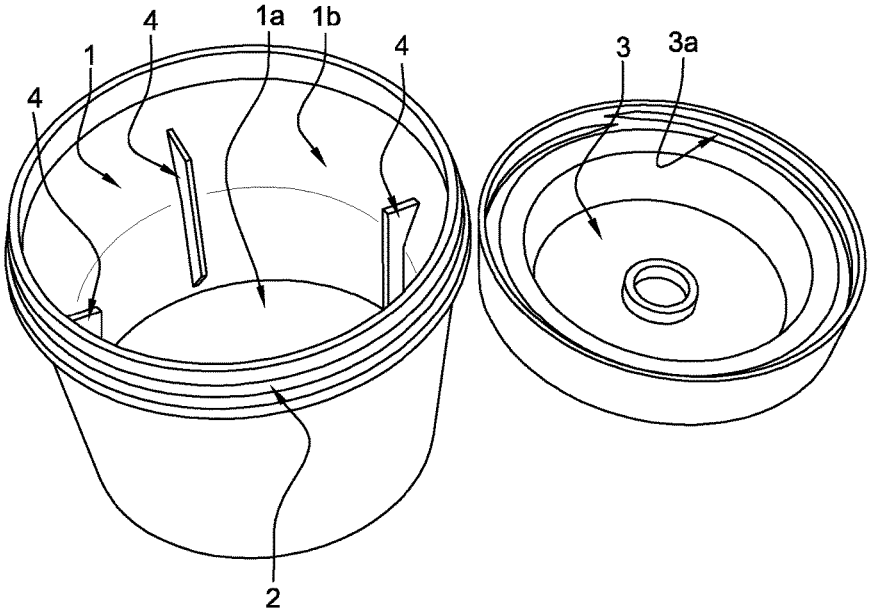
4
1a
1b
1
4
4
3
3a
2

CONTAINER FOR CLEANING AN OBJECT SUBMERGED IN A FLUID COMPRISING FERROMAGNETIC COMPONENTS

This application in the national stage (Rule 371) of international application No. PCT/FR2014/051901 filed Jul. 23, 2014.

FIELD OF THE INVENTION

The present invention relates to the technical field of the cleaning of an object, particularly by submerging it in a fluid comprising ferromagnetic components, and by stirring said ferromagnetic components via magnets.

The invention particularly relates to a cleaning container intended to receive the object to be cleaned and the fluid comprising the ferromagnetic components.

The invention is particularly applicable to the cleaning of dental prostheses. It may however be envisaged to clean other objects such as jewels, mechanical parts, or even any other object fit for such a cleaning.

BACKGROUND OF THE INVENTION

A device for cleaning an object of the state of the art generally comprises:

- a container intended to receive the object to be cleaned as well as a fluid comprising ferromagnetic components,
- rotating magnets arranged opposite the bottom of the container, capable of emitting a magnetic field inside thereof,
- means for rotating said magnets around the median axis of the container, and
- a unit for controlling the means for causing the rotation.

Thereby, when the magnets are rotated, the ferromagnetic components are stirred within the container, thus enabling to clean the object.

The types of containers used for the previously-mentioned cleaning are of the type comprising a bottom wall, a lateral wall, and a closing lid.

However, they are not fully satisfactory in that they decrease the efficiency of the cleaning of the object. Indeed, during the cleaning, the ferromagnetic components tend to stagnate at the container periphery.

SUMMARY OF THE INVENTION

One of the aims of the invention thus is to overcome at least the previously-mentioned disadvantage by providing a container for cleaning an object submerged in a fluid comprising ferromagnetic components.

For this purpose, a container for cleaning an object has thus been designed. In known fashion, the container is intended to receive, in addition to the object to be cleaned, a fluid comprising ferromagnetic components. The container generally comprises a bottom wall, a lateral wall, and a removable closing lid. The container is transparent to magnetic fields and is in particular intended to be inserted into an appropriate cleaning device, particularly of the previously-described type.

However, and according to the invention, the lateral wall of said container comprises on the inside radially-protruding longitudinal fins. In other words, said fins are directed towards the central or median axis of the container. In the case of a container having a symmetry of revolution, said fins are directed towards the axis of revolution.

Further, said fins do not extend all the way to the center of the container or to the central or median axis of the container. Typically, they protrude from the internal wall of the container by a distance in the range from 5 millimeters to 2 centimeters.

Further, the fins do not extend all along the container height. Indeed, and according to an advantageous embodiment, there remains a margin of approximately 1 cm between the bottom of the container and the lower end of each of the fins.

Thereby, on cleaning, the container fins enable to push the ferromagnetic components towards the center of the container, thus optimizing their displacement within said container. The efficiency of the cleaning is not affected, and is even increased.

According to a specific embodiment, the container comprises four fins symmetrically arranged around the median axis of the container.

BRIEF DESCRIPTION OF THE DRAWING

Other features and advantages of the invention will clearly appear from the following non-limiting description of the invention, in connection with the single accompanying drawing, schematically showing in perspective view the cleaning container according to the invention.

DETAILED DESCRIPTION OF THE DISCLOSED EXAMPLE

The invention relates to a container intended to be inserted into an appropriate device enabling to clean an object, particularly by submerging it in a fluid comprising ferro-magnetic components, and by stirring said ferromagnetic components by the action of rotating magnets.

The ferromagnetic components are well known in the art and are for example needles of small dimensions, typically metallic and ferromagnetic. These components may thus be made of iron filings.

The objects to be cleaned may be of any type fit for such a cleaning and are for example dental prostheses, jewels, or even non-magnetic mechanical parts.

Referring to the accompanying drawing, the container (1) is transparent to magnetic fields and is of generally cylindrical shape. It defines, in particular, a bottom wall (1*a*) and a lateral wall (1*b*). A thread (2) is formed on the periphery of the container (1) and at the level of its upper end, to receive by screwing a closing lid (3) comprising a complementary internal threading (3*a*).

The container (1) is intended to receive, in addition to the object to be cleaned, a fluid comprising ferromagnetic components. It is advantageously made of plastic material by injection, and typically of polyethylene or polypropylene.

The lateral wall (1*b*) of said container (1) comprises on its inside four radially-protruding longitudinal fins (4). The fins (4) are arranged symmetrically around the median axis of the container (1) and do not extend all the way to the bottom (1*a*) of the container (1) to leave a margin of approximately 1 cm between the bottom (1*a*) of the container (1) and the lower end of the fins (4).

The fins advantageously result from a molding.

They extend towards the center of the container, or more specifically towards the median axis of the container, by approximately 1 centimeter, and have a thickness in the range from 1 to 5 millimeters.

During the cleaning, the ferromagnetic components are stirred in the fluid. The fins (4) of the container (1) enable to push the ferromagnetic components towards the center of the container (1). Thereby, the efficiency of the cleaning is optimized, due to the forming of a vortex created by the ferromagnetic components under the action of the magnetic field generated by the magnets fitting the cleaning device receiving the container or bowl of the invention.

As appears from the foregoing, the invention provides a fully satisfactory device and container (1) for cleaning an object submerged in a fluid comprising ferromagnetic components. The container (1) is advantageous as compared with those of the state of the art in that it enables to optimize the efficiency of the cleaning.

The invention claimed is:

1. A container comprising:

a lateral wall having a symmetry of revolution about a median axis, the lateral wall having formed thereon, at an exterior top portion, a thread;

a bottom wall adjacent to and in contact with the lateral wall;

a removable lid shaped to engage the lateral wall and including an interior threading complementary to, and configured to engage with, the thread of the lateral wall; and a plurality of fins arranged symmetrically about the median axis, each fin: (i) coupled to the lateral wall along an edge of the fin extending longitudinally along the lateral wall, (ii) having two corresponding planar surfaces extending inward from the lateral wall toward the median axis between 5 mm and 2 cm, and (iii) having a thickness between the two corresponding planar surfaces between 1 mm and 5 mm, wherein the container is transparent to magnetic fields, and wherein there remains a margin of approximately 1 centimeter between the bottom of the lateral wall and a lower end of each of the plurality of fins.

2. The container of claim 1, wherein the container has four fins.

* * * * *